United States Patent [19]

Gustafson et al.

[11] Patent Number: 4,566,211

[45] Date of Patent: Jan. 28, 1986

[54] MODULAR DISPLAY UNIT

[75] Inventors: John A. Gustafson, Barrington; D. Richard Dahlstrom, Chicago, both of Ill.

[73] Assignee: Dahlstrom Display, Inc., Chicago, Ill.

[21] Appl. No.: 664,543

[22] Filed: Oct. 25, 1984

[51] Int. Cl.[4] ..... G09F 7/00

[52] U.S. Cl. ..... 40/605; 40/611; 40/617; 211/199

[58] Field of Search ..... 40/605, 611, 617; 211/198, 199, 189, 195; 160/135, 351; 52/286

[56] References Cited

U.S. PATENT DOCUMENTS

| | | | |
|---|---|---|---|
| 758,088 | 4/1904 | Mixer | 40/611 |
| 2,210,652 | 8/1940 | Dennett | 160/135 |
| 2,940,606 | 6/1960 | Kurnitz | 40/605 |
| 3,314,551 | 4/1967 | Plastow | 211/199 |

FOREIGN PATENT DOCUMENTS

| | | | |
|---|---|---|---|
| 455480 | 7/1968 | Switzerland | 40/617 |

*Primary Examiner*—Robert Peshock
*Assistant Examiner*—Cary E. Stone
*Attorney, Agent, or Firm*—McCaleb, Lucas & Brugman

[57] ABSTRACT

A free-standing or hanging knock-down-type modular display apparatus embodies a plurality of display panel-supporting frames hingedly interconnected side-to-side by one or more flexible and detachable unitary hinge-connectors allowing adjacent frames to be incrementally folded about a vertical axis. The adjacent frames have side-rails, each such rail having an outer peripheral face with openings into which the hinge-connectors may be inserted and detachably engaged. The hinge-connectors comprise a flexible central portion operatively extending between adjacent frames, i.e., from the outer peripheral face of a first frame side-rail, across a connective region between the frames, and into the outer peripheral face of a second adjacent frame side-rail. The flexible central portions of the connectors have terminal ends defining enlarged connector locking members, the frame side-rails of a pair of adjacent frames each having at least one key-hole slot adapted to receive the enlarged locking members of the connectors. The key-hole slots are of substantially less extent than the length of the frame side-rails.

8 Claims, 11 Drawing Figures

FIG. 1
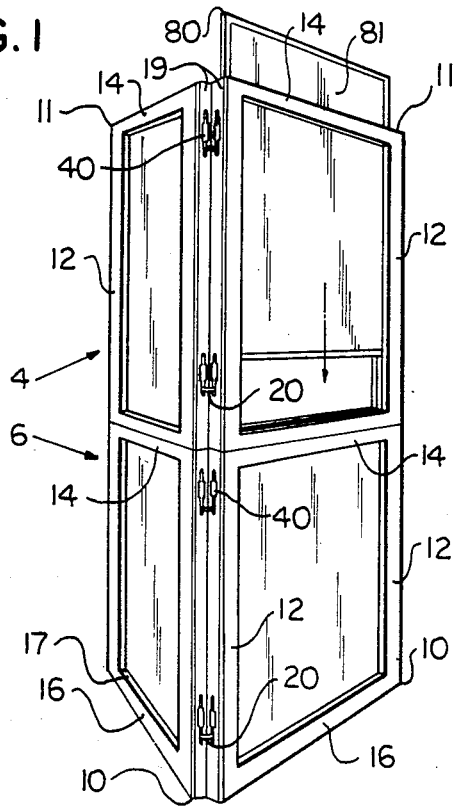
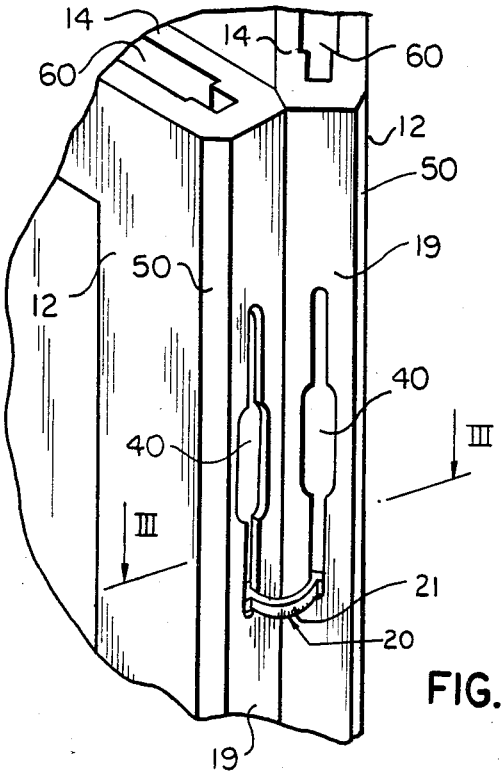
FIG. 2
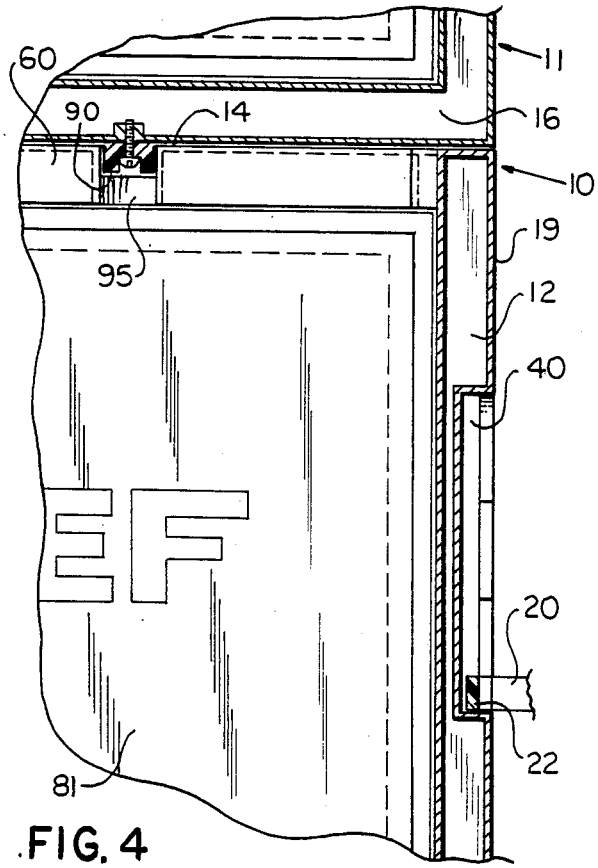
FIG. 4
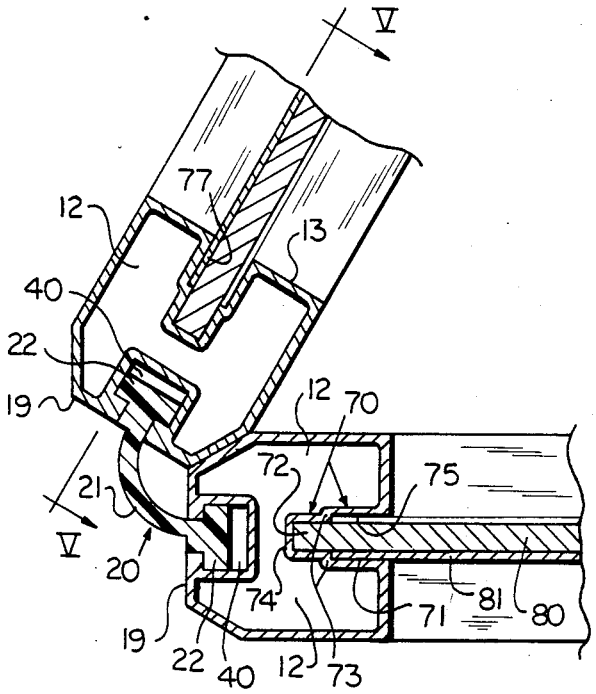
FIG. 3

MODULAR DISPLAY UNIT

BACKGROUND OF THE INVENTION

1. Field of the Invention

The present invention generally involves advertising display units of the portable, knock-down variety. In particular, the present disclosure relates to hanging or free-standing modular displays embodying a plurality of display panel-supporting frames attached to one another by flexible hinge-connectors allowing the frames to be incrementally folded about a vertical axis in various arrangements.

2. Description of the Prior Art

A number of patents disclose portable advertising displays. In particular, Donovan U.S. Pat. No. 4,166,332 discloses a display apparatus having a plurality of display panel-supporting frames which may be assembled into various arrangements. The Donovan patent discloses the use of plastic dovetail connectors which are slidably engaged into dovetail slots provided on frame uprights in the apparatus.

While it is recognized that portable modular displays should be simply constructed and easy to assemble, existing displays, such as the Donovan apparatus, above, have not fully addressed these objects. In particular, Donovan requires two types of frame supports for achieving either end-to-end or right-angle rigid placement of display panels. In addition, two types of connectors are described for achieving either a fixed or flexible attachment of frame uprights. The dovetail connectors utilized in Donovan must be slidably inserted into top open ends of dovetail-slotted frame supports of the apparatus, a feature which increases the level of manual dexterity required in assembling the apparatus.

Eaton U.S. Pat. No. 3,659,365 discloses a display structure having a three piece, dual-slotted frame stucture adapted to receive one or two display panels. The Eaton structure utilizes linear connector pins for vertical stacking of the frames. U-shaped pins are utilized for hinge-like connection of adjacent frames.

SUMMARY OF THE INVENTION

The present invention is directed to an improved modular display apparatus of the portable, knock-down variety. A display apparatus in accordance with the present invention is modestly constructed and requires a minimum of differing parts which can be assembled quickly and securely into a variety of attractively configured, free-standing or hanging advertising displays. Generally speaking, the invention is directed to the type of displays which embody a plurality of display panel-supporting frames wherein the frames are hingedly interconnected side-to-side allowing them to be incrementally folded with respect to one another about a vertical axis.

For use in the type of display apparatus as generally characterized above, the present invention is directed to the combination comprising one or more flexible unitary hinge-connectors and two or more quadrangular adjacent frames having side-rails, each such side-rail having an outer peripheral face having openings into which the hinge-connectors may be inserted and detachably engaged. The connectors comprise a flexible central portion operatively extending between adjacent frames, i.e., from an outer peripheral face of a first frame side-rail, across a connective region between the frames, and into an outer peripheral face of a second adjacent frame side-rail. The flexible central portions of the connectors have terminal ends defining enlarged connector locking members, and the frame side-rails of a pair of adjacent frames each have at least one key-hole slot adapted to receive the enlarged connector locking members, the key-hole slots being of substantially less extent than the length of the frame side-rails. The flexible central portion of the hinge-connectors can be constructed so as to define a deformable "I" (or linear) connection, a deformable "Y" connection, or an "X" (or cross-shaped) connection between the enlarged connector locking members, so as to facilitate a connective junction between two, three, or four frames, respectively.

According to another feature of the invention, construction of both the hinge-connectors and the display frame side-rails of the apparatus results in cooperation between the connectors and rails when the display frames are incrementally folded at various angles to one another, such cooperation being characterized in that a relatively short connective region or distance is made possible between adjacent frames, the extent of which distance is defined by the extent of the flexible central portion of the connectors. The short connective distance, while improving stability in the apparatus, is of sufficiently short extent to result in substantial rotation-limiting corner-edge contact between outer corners of adjacent frame side-rails, such contact occurring when either of the adjacent connected frames is folded through a relatively short arc distance with respect to the other. To overcome such substantial frame rotation-limiting contact resulting from utilization of short connectors, but without sacrificing the improved stability resulting therefrom, the frame side-rails have bevelled outer corners to substantially reduce such rotation-limiting frame corner contact, thereby enhancing rotatability of closely interconnected adjacent frames.

According to yet another feature of the invention, conventional single or dual-track frame slotting commonly seen in previous display devices is replaced with a unitary dual-width or dual-channeled internal frame groove, access to which is provided by a single frame top slot extending lengthwise across a top rail of the frames through which may be inserted a support or backing panel and one or two display panels resting against the front, and/or back face of the support panel, such panels being thus housed in laminate fashion in the unitary dual-width internal frame groove. The slotted top opening is aligned with the internal dual-width frame groove which extends along the inner periphery of the frames' side-rails and/or along the inner periphery of the bottom rails of the frames. The dual-channelled groove of the frames comprises a first wider channel descending into a frame side and/or bottom rail from the inner peripheries thereof and a second narrower channel opening into the first channel and descending therefrom to a terminal depth within the frame rail, whereupon the dual channels being continuous with one another define a single dual-width groove having at least one groove ledge located where the second narrower channel opens into the first wider channel. The dual-channelled groove accommodates a support or backing panel inserted through the top slot of the frame for snug fitment into the narrower groove channel thereof. One or two display panels of thinner printed stock may then be inserted into the frame through the top slot thereof to abutt the groove ledge of the dual-channelled groove and rest against the front and/or back face of the support panel as described above.

To facilitate stacking, quadrangular display frames according to the invention may be equipped with one or more bottom feet mateable with top recesses on the frames. Also, a display apparatus according to the present invention may be hung from the ceiling on hook means engaging the flexible central portions of the hinge-connectors.

It is an object of the present invention to provide a modular display apparatus of modest construction utilizing a minimum of different assembly parts which can be easily and securely combined to result in variously arranged free-standing or hanging displays.

A further object of the invention is to provide a modular display apparatus wherein the frames are interconnected in hinge-like relationship by flexible unitary hinge-connectors which may be easily inserted into and removed from locking engagement along adjacent frame sides when assembling or disassembling the apparatus.

Another object is to provide a display apparatus in which flexible connectors are so constructed as to achieve hinge-like attachment of two, three or four frames at a single connective junction.

Still another object is to provide a display apparatus having excellent connective stability and a wide range of foldability between adjacent connected frames.

Yet a further object is to provide a display apparatus wherein the frames are equipped with a single top opening aligned with a unitary internal frame groove capable of housing a single support panel and up to two display panels viewable on either side of the frame.

Still another object is to provide a display apparatus in which the frames may be vertically stacked or hung from ceiling hooks.

Other objects and uses of the present invention will become obvious to one skilled in the art upon examination of the following specification and claims in light of the accompanying drawings wherein:

FIG. 1 is a perspective view of a display apparatus according to the invention in which two 3-panel units are vertically stacked (the rear panels in the stacked display are not shown). A support panel and display panel are shown partially inserted in one of the display frames of the apparatus.

FIG. 2 is an enlarged perspective view showing the connective junction between two of the adjacent upper frames of the apparatus of FIG. 1. A flexible detachable hinge-connector is shown engaged in key-hole slots present in the frame side-rails.

FIG. 3 is a cross-sectional view taken along line III—III of FIG. 2, showing the frame key-hole slots, a connector engaged therein, and unitary dual-chanelled internal frame grooves housing support panels and display panels in the frames.

FIG. 4 is a cross-sectional view of the apparatus taken along lines IV—IV of FIG. 3. On the upper frame a foot projecting beneath a lower rail thereof, for stacking, is shown positioned in a recess provided on a top rail of the lower frame.

DESCRIPTION OF THE INVENTION

Figure 5:
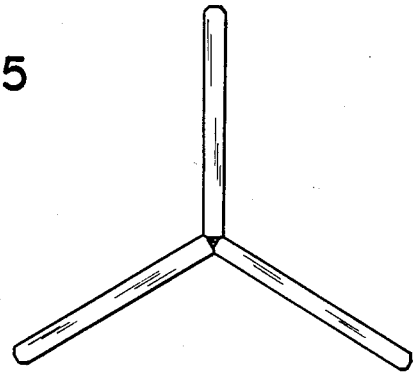
FIGS. 5–7 are simplified plan views suggestive of several possible display frame arrangements using linear (FIG. 7), Y-shaped (FIG. 5) or X-shaped (FIG. 6) hinge-connectors.

In the drawings, FIG. 1 illustrates a modular display apparatus in which a pair of three-sided display units 4 and 6 are vertically stacked. In FIG. 1 only two of the three display panel sides of the stacked bi-level apparatus are shown, a third side is not shown. The stacked display apparatus of FIG. 1 contains three upper quadrangular display frames 11 connected side-to-side by hinge-connectors 20 and three lower frames 10 similarly connected to result in triangular stacked units 4 and 6. Side-to-side interconnection of the frames is accomplished by flexible and detachable unitary hinge-connectors 20 operatively extending between the lower adjacent frames 10 and between the upper adjacent frames 11. Hinge-connectors 20 are detachably engaged in matching keyhole slots 40 present in the outer peripheral walls 19 (see also FIG. 2) of adjacent frame side-rails 12 and at uniform locations thereon such that keyhole slots 40 on any two adjacent frames are substantially opposable when the adjacent frames are positioned adjacent to one another for connection thereof. FIG. 1 further depicts a support panel 80 and display panel 81 partially inserted into one of the display frames 11 of the display apparatus. A frame top slot 60 is shown in FIG. 2 for insertion of the support panel and display panel into frame 11.

FIG. 2, 3 and 4 illustrate in greater detail the stacking features of the modular display apparatus shown in FIG. 1, plus the operation and structure of hinge-connectors 20, and the interrelationship of support panels 80 and display panels 81 which may be inserted in display frames 10 and 11. More particularly, in FIGS. 2 and 3 the unitary flexible hinge-connector 20 is shown detachably engaged in matched keyhole slots 40. As shown in FIG. 3, hinge-connector 20 comprises a flexible central portion 21 having terminal ends defining connector locking members 22. To assemble a display apparatus of the present invention such as that depicted in FIG. 1, or to assemble any number of stacked or uniquely configured units such as those illustrated in FIG. 5,6, and 7, any two or more quadrangular display frames 10, 11 may be connected along adjacent parallel side-rails 12 thereof by inserting a connector locking member 22 of a hinge-connector 20 into the enlarged opening of a keyhole slot 40 present in the outer peripheral wall 19 of a frame side-rail 12, and sliding hinge-connector 20 downwardly into locking position within keyhole slot 40, whereupon the other locking end (or ends) 22 of the connector 20 may then be inserted into an opening 40 of an adjacent frame side-rail (or rails) 12, and so on. Hinge-connectors 20 are flexible such that connected frames may be incrementally folded about a vertical folding axis established by the connectors.

As shown in FIGS. 2 and 3 frame side-rails 12 have bevelled outer corners 50 to reduce frame corner-contact impediment occurring when the display frames 10 are folded. Bevelled corners 50 permit utilization of relatively short hinge-connectors 20 which improve overall stability in the apparatus, without objectionably impairing frame foldability about the folding axis of the connectors.

As shown in FIG. 3, inserted in display frame 10 is a support panel 80 and one or two thin display panels which carry the advertising message of the display unit. Support panel 80 and panels 81 are inserted into frames 10 through slotted top openings 60 (see FIG. 2) which extend along top rails 14 of frames 10,11. Slots 60 are aligned with internal unitary dual-width or dual-channelled frame grooves 70 (see FIG. 3) which are adapted to recieve support panel 80 and display panels 81. Dual-channelled grooves 70 extend along the inner periphery 13 of frame side rails 12 and preferably continue along the inner periphery of bottom frame rails 16 (see FIG. 1) of frames 10.

Referring to FIG. 3, dual-channelled frame grooves 70 comprise a wider channel 71 descending into frame side-rails 12 and into bottom-rails 16 from the inner peripheries 13 and 17 thereof, and a narrower channel 72 opening into wider channel 71 and descending therefrom to a terminal wall 74 within frame rails 12 and 16. Wider and narrower channels 71 and 72 being continuous with one another define one or two groove ledges 73, located at a point in groove 70 where channels 71 and 72 merge. As shown in FIG. 3, narrower groove channel 72 acts as a slot for reception of support panel 80. Support panel 80, wider channel 71, and one (or two) groove ledges 73, define one or a pair of slots 77 which receive thin printed display panels 81, the latter being inserted through top slot 60 to lie flat against either face of support panel 80 in laminate fashion, the side edges of display panels 81 abutting groove ledges 73. Optionally, to facilitate insertion of display panels 81 in slots 77 after support panel 80 has been inserted into place, opposing channel walls 75 of wider channel 71 may be inclined slightly outwardly from one another such that channel 71 is wider at its opening along inner peripheries 13 and 17 of frame rail 12 and 16 than at its terminus at groove ledge (or ledges) 73.

FIG. 4 illustrates the stacking features of the modular display apparatus of the present invention. Upper display frame 11 is equipped with one or more stacking feet 90 projecting from a bottom frame rail 16 of frame 11 into one or more stacking recesses 95 provided in the top-rail 14 of lower frame 10.

Figure 6:
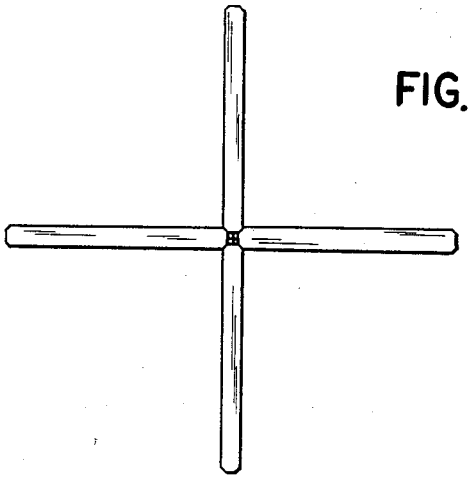
Figure 7:
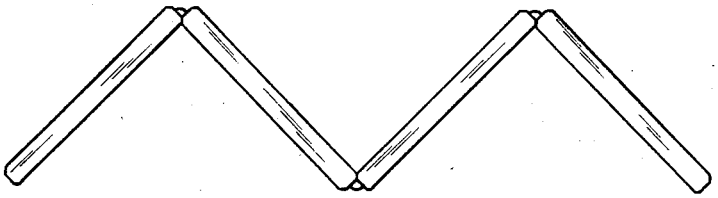
Figure 8:
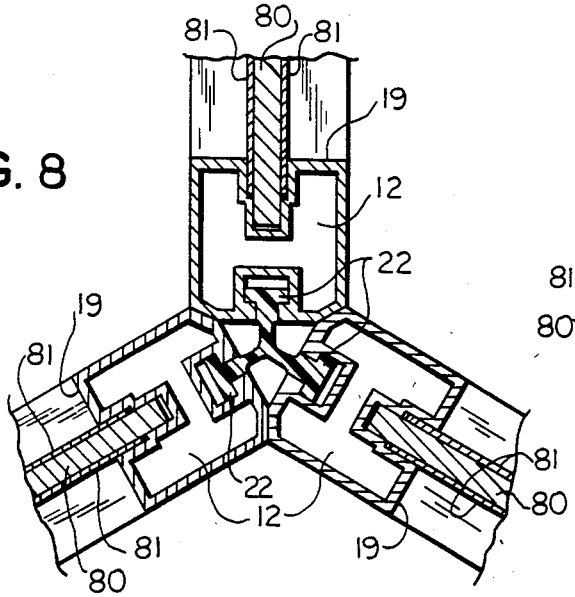
FIG. 8 is a horizontal cross-sectional view depicting the connective area of three display frames wherein a Y-shaped connector is employed. Each frame is shown containing a support panel and two thin display panels, resting on either face of the support panel.
Figure 9:
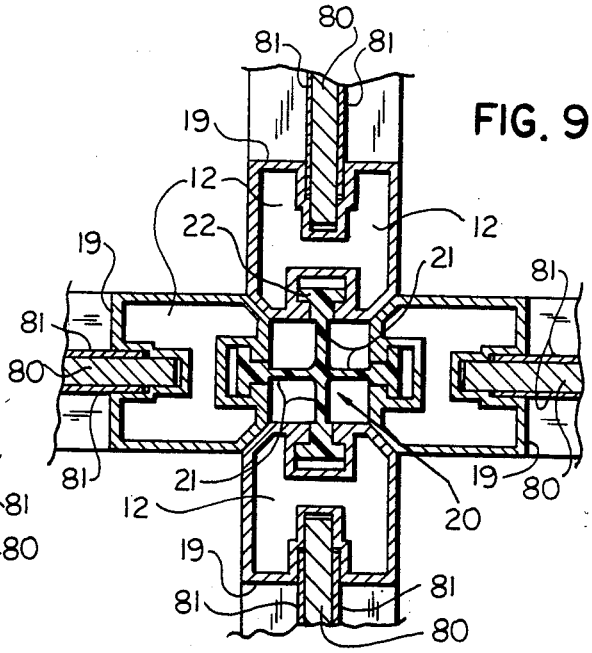
FIG. 9 is a horizontal cross-sectional view of the connective area of four display frames.

FIGS. 8 and 9 illustrate alternate embodiments of the hinge-connector 20 shown in FIGS. 1 to 4 falling within the scope of the invention. Connectors 20 in FIGS. 8 and 9 allow display panels of the invention to be assembled into Yshaped or X-shaped display segments. FIGS. 5 and 6 are simplified plan views corresponding to FIGS. 8 and 9. A linear connector 20 (such as that shown in FIG. 3) may be used to assemble an apparatus such as that in FIG. 7.

Figure 10:
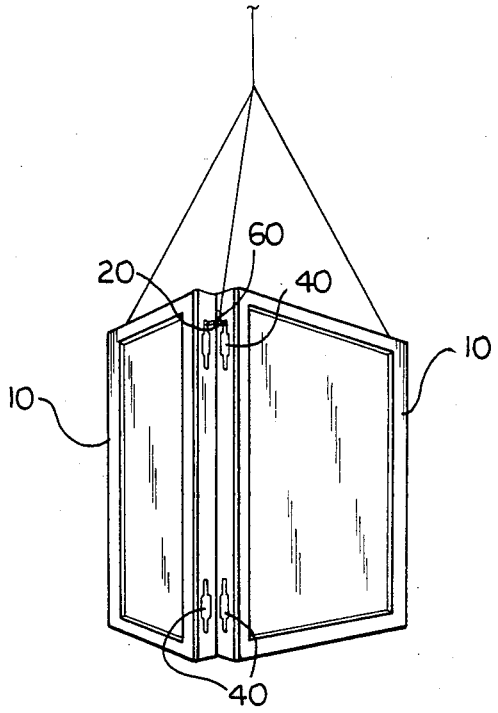
FIG. 10 is a 3-panel display unit hung from ceiling hooks (rear panel, not shown) wherein the ceiling hooks engage the hinge-connectors.
Figure 11:
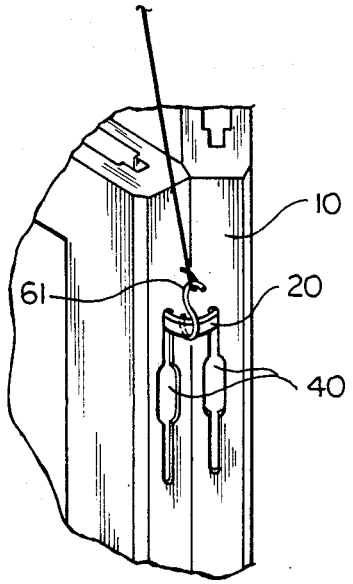
FIG. 11 is an enlarged portion of FIG. 10 showing engagement of a ceiling hook with a hinge-connector in the display unit of FIG. 10.

FIGS. 10 and 11 illustrate a triangular 3-panel apparatus hung by ceiling hooks 61 engaging hinge-connectors 20.

Numerous variations in the construction and geometry of the display apparatus described herein will become apparent to those skilled in the art. It is therefore to be expressly understood that the present invention is limited in scope only by the appended claims and not by the preceeding description.

I claim:

1. For use in a knock down-type modular display apparatus embodying quadrangular display frames adapted to receive display panels wherein the frames are hingedly interconnected side-to-side allowing them to be incrementally folded about a vertical axis, the combination comprising: one or more flexible unitary hinge connectors and two or more adjacent quadrangular frames having side rails, each such side rail having an outer peripheral face formed with one or more openings into which the hinge-connectors may be inserted and detachably interlocked therewith; the connectors each comprising a flexible elongated central portion operatively extending between adjacent frames from one of said openings in the outer peripheral face of a first frame side rail, across a connective region between the frames and into an opposing one of said openings in the outer peripheral face of a second frame side rail; the flexible central portion of each connector having enlarged terminal ends defining connector locking members; each of said openings in each frame side rail comprising a keyhole slot receptive of a said connector locking member therein via a widened opening portion thereof and operable to removably lock said locking member behind a narrowed opening portion thereof; the keyhole slots being of substantially less lengthwise extent than the length of a said frame side rail and located intermediate the ends thereof.

2. The modular display apparatus of claim 1 wherein the flexible central portion of one or more connectors therein defines a deformable linear connection extending between the enlarged connector locking members.

3. The modular display apparatus of claim 1 wherein the flexible central portion of one or more connectors therein defines a T-shaped connection extending between the enlarged connector locking members thereof.

4. The modular display apparatus of claim 1 wherein the flexible central portion of one or more connectors therein defines an esentially X- or cross-shaped connection extending between the connector locking members thereof.

5. The modular display apparatus of claim 1 wherein the connective region between adjacent connected display frames includes a connective distance therebetween defined by the lengthwise extent of the flexible central portion of the hinge-connectors between the enlarged locking ends of said connectors, the connective distance being sufficiently short extent as to result in substantial rotation-limiting contact between outer corners of adjacent frame side-rails, such contact occurring when either of said adjacent connected frames is rotated through a relatively short arc distance with respect to the other, the frame-side rails having planar bevelled outer corners to substantially reduce such rotation-limiting frame corner contact thereby enhancing rotatablility and stability of closely interconnected adjacent frames.

6. The display apparatus of claim 1 wherein the apparatus is hung from hook means engaging the flexible central portions of the hinge-connectors.

7. The modular display apparatus of claim 1 wherein one or more of the quadrangular display frames are structured with a slotted top opening extending lengthwise across a top rail thereof, the slotted top opening being aligned with a unitary internal dual-channelled frame groove, the groove extending along an inner periphery of said one or more frames' side rails, and along an inner periphery of a bottom rail of the frames, the slotted top opening and internal frame groove aligned therewith allowing insertion into the frames of a support panel and at least one display panel resting thereagainst, the dual-channelled grooves each comprising a first wider channel descending into the frames' side and bottom rails along the inner peripheries thereof, and a second narrower channel opening into the first channel and descending therefrom to a terminal depth within the frame rails, whereupon the dual channels being continuous with one another define a single dual-width groove having at least one groove ledge located where the second narrower channel opens into the first channel, the support panel being inserted through the slotted top opening of the frame for snug fitment in the second narrower groove channel, and said at least one display panel being inserted through said slotted top opening such that side and/or bottom edges of said at least one display panel fit abuttingly along said at least one groove ledge, whereby the support panel serves as a backing for the display panel, the latter resting thereagainst.

8. The modular display apparatus of claim 1 wherein the quadrangular frames have one or more bottom feet and one or more recesses in operational horizontal rails thereof, said recesses and feet being mateable to facillitate vertical stacking of the frames.

* * * * *

UNITED STATES PATENT AND TRADEMARK OFFICE

CERTIFICATE OF CORRECTION

PATENT NO. : 4,566,211

DATED : January 28, 1986

INVENTOR(S) : GUSTAFSON, JOHN A. & DAHLSTROM, RICHARD D.

It is certified that error appears in the above—identified patent and that said Letters Patent is hereby corrected as shown below:

Column 5, line 57, after "Y' insert a hyphen;

Column 6, line 37, cancel "T-shaped" insert --Y-shaped--.

Signed and Sealed this

*Twenty-fourth* Day of *June 1986*

[SEAL]

*Attest:*

DONALD J. QUIGG

*Attesting Officer*

*Commissioner of Patents and Trademarks*